US008028610B2

(12) United States Patent
Kewes et al.

(10) Patent No.: US 8,028,610 B2
(45) Date of Patent: Oct. 4, 2011

(54) CUTTING LINK FOR A SAW CHAIN

(75) Inventors: Marco Kewes, Constance (DE); Rainer Rühle, Wil (CH); Manfred Vogler, Kiefersfelden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 487 days.

(21) Appl. No.: 12/232,027

(22) Filed: Sep. 10, 2008

(65) Prior Publication Data

US 2009/0107317 A1 Apr. 30, 2009

(30) Foreign Application Priority Data

Oct. 24, 2007 (DE) ..... 10 2007 050 778

(51) Int. Cl.
*B27B 33/14* (2006.01)

(52) U.S. Cl. ..... 83/831; 83/833; 83/834

(58) Field of Classification Search ..... 83/830, 83/831, 834, 832, 833, 853, 852, 848; 30/381
See application file for complete search history.

(56) References Cited

U.S. PATENT DOCUMENTS

| | | | | |
|---|---|---|---|---|
| 2,976,900 | A * | 3/1961 | Mills | 83/834 |
| 3,477,480 | A * | 11/1969 | Gasner | 83/831 |
| 3,519,039 | A * | 7/1970 | Ehlen | 83/834 |
| 4,606,253 | A * | 8/1986 | Weigel | 83/830 |
| 4,841,824 | A * | 6/1989 | Hartmann et al. | 83/830 |
| RE37,288 | E * | 7/2001 | Burrows et al. | 83/834 |
| 2005/0178263 | A1 * | 8/2005 | Szymanski | 83/831 |

FOREIGN PATENT DOCUMENTS

WO WO 2004/113035 12/2004

* cited by examiner

*Primary Examiner* — Ghassem Alie
(74) *Attorney, Agent, or Firm* — Walter Ottesen

(57) ABSTRACT

A cutting link (1) for a saw chain includes a base body (2) and a cutting tooth (3) mounted thereon and made of hard metal. The base body (2) has rivet openings (4) and a recess (6) is formed in the base body (2) for chip removal with the recess (6) being ahead of the cutting tooth (3) in running direction. A connecting leg (8) of the cutting tooth (3) is brought into surface contact laterally of the base body (2) and the cutting tooth (3) is firmly bonded to the base body (2) by brazing. The connecting leg (8) extends so far downwardly that a lower edge (13) thereof lies lower than the recess (6). The connecting leg (8) has an upwardly raised edge (15) in its rearward region opposite the neighboring rivet opening (4).

13 Claims, 2 Drawing Sheets

CUTTING LINK FOR A SAW CHAIN

CROSS REFERENCE TO RELATED APPLICATION

This application claims priority of German patent application no. 10 2007 050 778.1, filed Oct. 24, 2007, the entire content of which is incorporated herein by reference.

BACKGROUND OF-THE INVENTION

U.S. Pat. No. 3,519,039 discloses a cutting link for a saw chain which has an essentially planar base plate having flat sides parallel to each other. In this base plate, openings are provided which accommodate rivets for connecting to additional chain links. A cutting tooth is attached to the base plate and projects somewhat-beyond the rearward end of a recess in the base plate. The cutting tooth is made of hard metal and is bonded to the base plate via brazing.

With respect to its configuration, the known cutting tooth is relatively massive and the cutting tooth engages over the base plate at both sides at its upper edge in order to provide a reliable bond. In this way, the configuration of the cutting tooth is complicated and this leads to a high complexity with respect to manufacture.

International patent publication WO 2004/113035 A2 discloses a cutting link for a saw chain which comprises a base body and a cutting tooth attached thereon. The base body is provided with a laterally projecting wedge tapered in the running direction of the cutting link and this wedge serves to provide a form-tight accommodation of the cutting tooth. The cutting tooth has essentially a U-shaped cross section with a corresponding lateral slot which has a form complementary to the base body so that the cutting tooth is attached on the base body via insertion. The cutting tooth is made of a hard metal.

It is apparent that this configuration of the base body and the cutting tooth is most complex and leads to very high costs, especially because the mass of the necessary hard metal is relatively large.

SUMMARY OF THE INVENTION

It is an object of the invention to provide a cutting link of the type described above wherein a reliable attachment of the cutting tooth to the base body is provided also with a simple configuration of the cutting tooth and for a small dimensioned cutting link.

The cutting link of the invention is for a saw chain having a running direction (A). The cutting link defines a horizontal axis (H) and includes: a base body being a planar plate and having first and second rivet openings formed therein; a cutting tooth made of hard metal and attached to the base body; the cutting tooth having a roof section and a connecting leg; the base body having a recess formed therein forward of the cutting tooth viewed in the running direction (A) for conducting away chips; the cutting tooth partially overlapping the recess; the connecting leg being in surface contact with the base body laterally thereof; the cutting tooth and the base body being firmly bonded to each other by brazing utilizing a brazing solder; the connecting leg having a first edge in the form of a lower edge and the connecting leg extending downwardly so far that the lower edge lies lower than the recess; the connecting leg having, viewed in the running direction (A), a rearward region; and, the rearward region of the connecting leg having an upwardly pulled second edge lying opposite one of the rivet openings.

The cutting link of the invention is simple in assembly and can therefore be cost effectively manufactured. Because of the large connecting surface for the firm bond, a reliable hold of the cutting tooth on the base body is provided. A mounting of the rivets in the assembly of the saw chain is not hindered because of the special configuration of the cutting tooth in the region next to the rivet opening.

According to a practical embodiment of the cutting link, a bevel is provided at the lower edge of the connecting leg. This bevel facilitates the chip flow. Furthermore, it is practical that the edge runs upwardly inclined in the direction toward a rearward end of the base body at an angle to the horizontal axis. The angle of this edge referred to a horizontal of the base body preferably lies in the region of approximately 15°. A silver solder is especially suitable for the brazed bond of the cutting tooth and base body. The soldering temperatures lie in a range between 700° C. and 750° C., that is, in a temperature range which does not have a negative effect on the hardened material in the functionally relevant region of the cutting tooth.

The lateral cutting edge of the cutting tooth is preferably configured in the form of a concave channel. The lateral cutting edge has a bevel on the side facing toward the base body. The bevel angle is approximately 40° referred to the longitudinal direction of the cutting link.

To improve the chip flow, a bevel is provided at the recess for chip diversion in the rearward region of the recess. A stop is formed at the upper edge of the base body against which a rearward end of the cutting tooth lies. In this way, a form-tight connection of the base body and cutting tooth is additionally provided in the longitudinal direction of the cutting link. It is furthermore practical that the cutting tooth covers the recess to such an extent that the sharpening of the cutting edge is possible without a removal of material of the base body.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
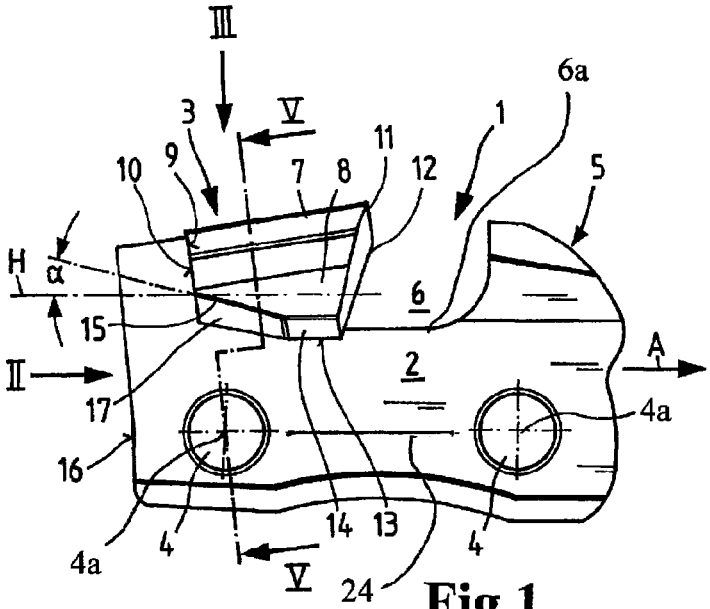
FIG. 1 is a side elevation view of a cutting link having a right-hand cutting tooth.

FIG. 1 shows a cutting link 1 for a saw chain in a side elevation view. The cutting link 1 includes a base body 2 and a cutting tooth 3 which is made of hard metal and is attached to the base body 2 by brazing. The running direction of the cutting link 1 when used in the saw chain is indicated by arrow A. The cutting tooth of the cutting link shown in FIG. 1 is a right cutting tooth 3 referred to the running direction A. The base body is provided with two rivet openings 4 in its lower half. Referred to the running direction A, a depth limiter 5 is arranged above the forward rivet opening 4 on the upper edge of the base body 2. Behind the depth limiter 5, the base body has a recess or cutout 6 for directing chips away.

Rivet openings 4 have respective centers 4*a* and an imaginary line 24 connects these centers. Reference numeral 6*a* identifies the bottom of the recess 6. The recess bottom 6*a* faces toward the imaginary line 24 connecting the two rivet centers 4*a*.

The cutting tooth 3 includes a roof section 7 which extends over the upper end of the base body 2 and has a connecting leg 8 which lies against the side of the base body 2 and provides a large-area connection of the cutting tooth 3 to the base body 2. The connecting leg 8 projects so far downwardly that a lower edge 13 lies deeper than the base of the recess 6.

A rearward edge 9 of the cutting tooth 3 lies against a stop 10 which is formed on the upper edge of the base body 2. The cutting tooth 3 has a roof cutting edge 11 and a lateral cutting edge 12 which are disposed in the region of the rearward end of the recess 6. The lower edge 13 of the connecting leg 8 is provided with a bevel 14. The chip removal is improved with this configuration.

FIG. 1 further shows that the connecting leg 8 has an upwardly raised edge 15 at the rearward region thereof viewed in the running direction (A) of the cutting link. The edge 15 lies opposite the rearward neighboring rivet opening. This edge 15 runs inclined upwardly in a direction toward a rearward end 16 of the base body 2 at an angle ($\alpha$) to a horizontal axis H of the base body 2. The angle ($\alpha$) is approximately 15° in the embodiment shown. An inclined surface 17 extends from the upwardly raised edge 15 in a direction toward the rivet opening 4 so that, on the one hand, the free space for riveting is provided and, on the other hand, an optimal soldering surface is provided as especially shown in FIG. 5.

Figure 2:
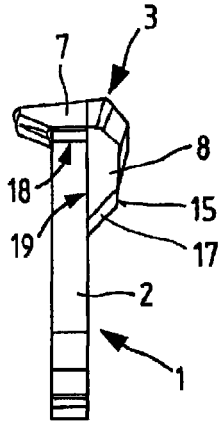
FIG. 2 is an end view of the cutting link in the direction of arrow II in FIG. 1.

FIG. 2 shows a view of the cutting link 1 in the direction of arrow II in FIG. 1. From this it is apparent that the base body 2 is essentially a planar plate. The cutting tooth lies against the base body 2 at the upper edge 18 of the base body and at a contiguous section 19 of a flat side. The cutting tooth 3 is firmly bonded to the base body by brazing preferably with silver solder. In this case, the solder temperature lies in the range between 700° C. and 750° C. The roof section 7 and the connecting leg 8 are seen on the cutting tooth 3 and the connecting leg lies with a large area on the section 19 of the base body. Furthermore, the edge 15 and the inclined surface 17 are shown.

Figure 3:
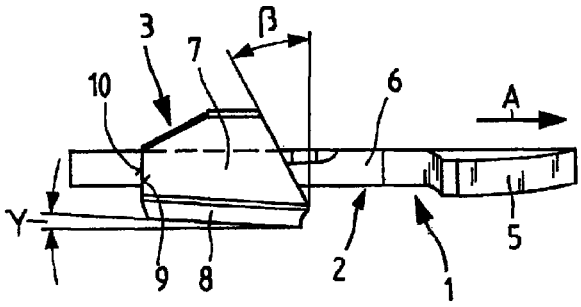
FIG. 3 is a plan view of the cutting link viewed in the direction of arrow III in FIG. 1.

FIG. 3 is a plan view of the cutting link 1 viewed in the direction of arrow III of FIG. 1. Viewed in the running direction A, the depth limiter 5 is formed forwardly on the base body 2 and a recess is disposed behind the depth limiter and the cutting tooth 3 begins at the rearward region of the recess. The roof cutting edge 11 is formed on the roof section 7 and, in the embodiment, runs at an angle ($\beta$) to the orthogonal of the running direction A of approximately 28°. The lateral cutting edge 12 begins at the forward end of the cutting tooth 3 and runs inclined downwardly as shown in FIG. 1. The connecting leg is so configured on the outer side thereof that this outer side runs at an angle ($\gamma$) to the side surface of the base body. The rearward edge of the cutting tooth 3 lies against a stop 10 of the base body 2.

Figure 4:
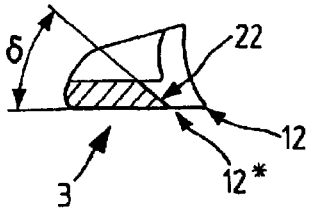
FIG. 4 is a detail enlarged schematic of a section through a lateral cutting edge of the cutting tooth in the sharpened state.

FIG. 4 shows an enlarged detail of the cutting tooth 3 in a section through the lateral cutting edge 12*. During manufacture of the cutting tooth 3, the lateral cutting edge acquires the form indicated by reference numeral 12 from grinding. A cutting angle ($\delta$) of approximately 40° is shown in the embodiment. A bevel 22 is likewise seen in FIG. 4. The bevel 22 is disposed on the lateral cutting edge 12 in the ground state.

Figure 5:
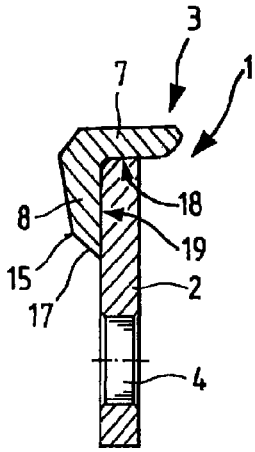
FIG. 5 is a section view taken along line V-V of FIG. 1.

FIG. 5 shows a section taken along line V-V in FIG. 1 from which it can be seen that the base body 2 is a planar plate. The cutting tooth 3 lies with its roof section 7 on the upper edge 18 of the base body 2 and with its connecting leg 8 on the section 19. The firm bonding via brazing takes place on the surfaces marked by reference numerals 18 and 19. Furthermore, it can be seen that the outer side of the connecting leg 8 is slightly inclined downwardly toward the base body 2 and an inclined surface 17 to the base body 2 extends from the edge 15.

Figure 6:
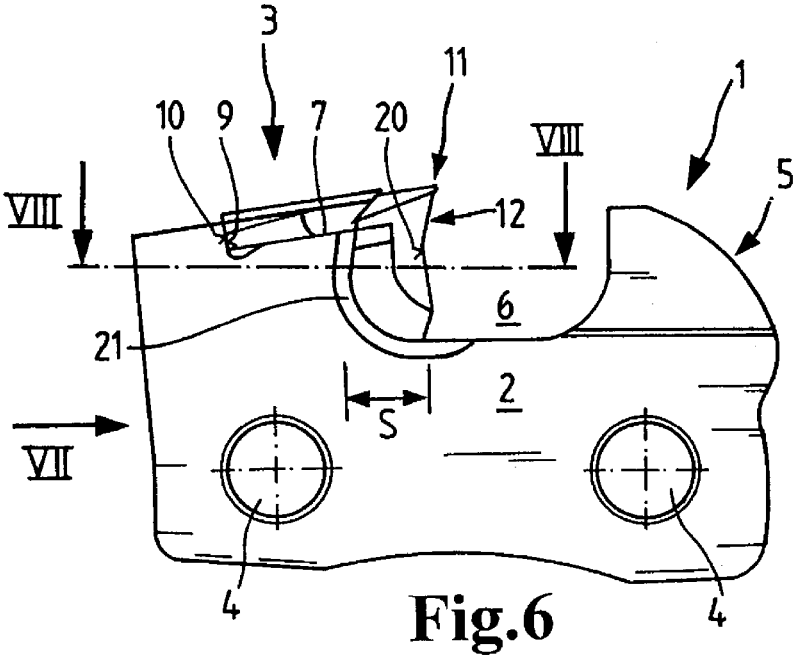
FIG. 6 is a side elevation of a cutting link having a left-hand cutting tooth.

FIG. 6 shows a cutting link 1 having a left-hand cutting tooth 3. The base body 2 and the cutting tooth 3 are the exact mirror image to the cutting link shown in FIG. 1 referred to the running direction A. FIG. 6 shows that the cutting edge 12 is in the form of a concave channel 20. This form is generated by grinding the cutting tooth 3,made of hard metal. The cutting tooth 3 projects laterally by the dimension S along the recess 6 so that the roof cutting edge 11 and the lateral cutting edge 12 are effectively brought into engagement with the material to be cut. The chips are directed away rearwardly and downwardly in the recess 6. To further improve the chip flow, a bevel 21 is provided in the rearward region of the recess 6. The same reference numerals apply to the same parts in FIG. 6 as in FIG. 1.

Figure 7:
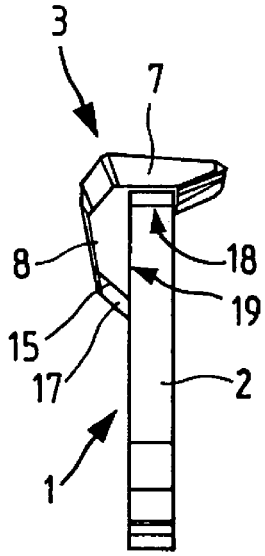
FIG. 7 is a view of the cutting link in the direction of arrow VII in FIG. 6; and, FIG. 8 is a section view taken along line VIII-VIII of FIG. 6.

FIG. 7 shows the view of the cutting link 1 in the direction of arrow VII of FIG. 6. This shows that a mirror image arrangement is provided here which was referred to above with respect to FIG. 6 as a comparison to FIG. 2. For the same parts, the same reference numerals apply here which apply in FIG. 2.

Figure 8:
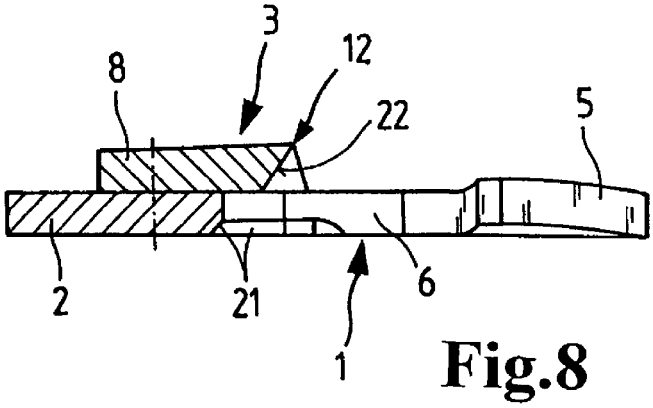

FIG. 8 shows a section along the line VIII-VIII in FIG. 6. This schematic also shows that the cutting tooth 3 partially laterally overlaps the recess 6, that is, in the starting state. The overlapment is by an amount S as described with respect to FIG. 6. The dimension S becomes less with a required regrinding of the cutting tooth 3. A further grinding beyond the bevel 21 is possible and this is a simultaneous grinding of steel and hard metal.

It is understood that the foregoing description is that of the preferred embodiments of the invention and that various changes and modifications may be made thereto without departing from the spirit and-scope of the invention as defined in the appended claims.

What is claimed is:

1. A cutting link for a saw chain having a running direction (A), the cutting link defining a horizontal axis (H) and comprising:

a base body being a planar plate and having first and second rivet openings formed therein;

said rivet openings defining respective centers connected by an imaginary line;

a cutting tooth made of hard metal and attached to said base body;

said cutting tooth having a roof section and a connecting leg;

said base body having a recess formed therein forward of said cutting tooth viewed in said running direction (A) for conducting away chips;

said cutting tooth partially overlapping said recess;

said connecting leg being in surface contact with said base body laterally thereof;

said cutting tooth and said base body being firmly bonded to each other by brazing utilizing a brazing solder;

said recess having a recess bottom facing toward said imaginary line connecting said rivet centers;

said connecting leg having a first edge in the form of a lower edge and said connecting leg extending downwardly so far that said lower edge lies lower than said bottom of said recess;

said connecting leg having, viewed in said running direction (A), a rearward region; and, said rearward region of said connecting leg having a second edge lying opposite one of said rivet openings and said second edge running upwardly relative to said first edge and away from said one rivet toward a rearward edge of the rearward region.

2. The cutting link of claim 1, wherein said lower edge has a bevel formed thereon.

3. The cutting link of claim 1, wherein said base body has a rearward end and said second edge runs inclined upwardly in a direction toward said rearward end of said base body at an angle ($\alpha$) to said horizontal axis (H).

4. The cutting link of claim 1, wherein said brazing solder is a silver solder.

5. The cutting link of claim 1, wherein said cutting tooth has a lateral cutting edge and said lateral cutting edge is configured in the form of a curved or concave edge surface.

6. The cutting link of claim 1, wherein said cutting tooth has a lateral cutting edge and said lateral cutting edge has a side facing toward said base body; and, said lateral cutting edge has a bevel formed on said side thereof with said bevel defining a bevel angle ($\delta$) of approximately 40° referred to the longitudinal direction of said cutting link.

7. The cutting link of claim 6, wherein said lateral cutting edge with said bevel is generated by grinding.

8. The cutting link of claim 1, wherein said recess has a rearward region and a bevel formed in said rearward region to facilitate a removal of chips.

9. The cutting link of claim 8, wherein said bevel is formed by pressing.

10. The cutting link of claim 1, wherein said base body has an upper edge and a stop formed in the region of said upper edge; and, said cutting tooth has a rearward end in contact engagement with said stop.

11. The cutting link of claim 1, wherein said cutting tooth has a roof cutting edge and a lateral cutting edge; and, said cutting tooth overlaps said recess by an amount (S) so as to permit grinding said cutting edges without a removal of the material of said base body.

12. The cutting link of claim 1, wherein material of said cutting tooth and said base body is removed during regrinding.

13. A cutting link for a saw chain having a running direction (A), the cutting link defining a horizontal axis (H) and comprising:

a base body being a planar plate and having first and second rivet openings formed therein;

said rivet openings defining respective centers connected by an imaginary line;

a cutting tooth made of hard metal and attached to said base body;

said cutting tooth having a roof section and a connecting leg;

said base body having a recess formed therein forward of said cutting tooth viewed in said running direction (A) for conducting away chips;

said cutting tooth partially overlapping said recess;

said connecting leg being in surface contact with said base body laterally thereof;

said cutting tooth and said base body being firmly bonded to each other by brazing utilizing a brazing solder;

said recess having a recess bottom facing toward said imaginary line connecting said rivet centers;

said connecting leg having a first edge in the form of a lower edge and said connecting leg extending downwardly so far that said lower edge lies lower than said bottom of said recess;

said connecting leg having, viewed in said running direction (A), a rearward region;

said rearward region of said connecting leg having a second edge lying opposite one of said rivet openings and said second edge running upwardly relative to said first edge and away from said one rivet opening toward a rearward edge of the rearward region.

said recess having a rearward region and a bevel formed in said rearward region to facilitate a removal of chips;

said cutting tooth having a roof cutting edge and a lateral cutting edge; and, said cutting tooth overlapping said recess by an amount (S) so as to permit grinding said cutting edges without a removal of the material of said base body.

* * * * *